US008506759B2

(12) United States Patent
Spitzer et al.

(10) Patent No.: US 8,506,759 B2
(45) Date of Patent: Aug. 13, 2013

(54) BELT HAVING SEMICONTINUOUS PATTERNS AND NODES

(75) Inventors: Rebecca Howland Spitzer, Burlington, KY (US); Ward William Ostendorf, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 251 days.

(21) Appl. No.: 12/949,836

(22) Filed: Nov. 19, 2010

(65) Prior Publication Data

US 2011/0114277 A1 May 19, 2011

Related U.S. Application Data

(60) Provisional application No. 61/262,608, filed on Nov. 19, 2009.

(51) Int. Cl.

| | |
|---|---|
| ***D21H 27/40*** | (2006.01) |
| ***D21F 1/10*** | (2006.01) |
| ***B32B 3/10*** | (2006.01) |
| ***B32B 3/30*** | (2006.01) |

(52) U.S. Cl.

USPC ..... 162/296; 162/116; 162/348; 162/362; 428/196

(58) Field of Classification Search

USPC ..... 162/116, 117, 348, 358.1, 358.2, 162/900, 902, 903, 361, 362, 296; 139/383 A; 428/195, 196; 427/288, 412

See application file for complete search history.

(56) References Cited

U.S. PATENT DOCUMENTS

| | | | | |
|---|---|---|---|---|
| 4,514,345 | A | 4/1985 | Johnson et al. | |
| 4,528,239 | A | 7/1985 | Trokhan | |
| 5,073,235 | A | 12/1991 | Trokhan | |
| 5,098,522 | A | 3/1992 | Smurkoski et al. | |
| 5,260,171 | A | 11/1993 | Smurkoski et al. | |
| 5,628,876 | A * | 5/1997 | Ayers et al. | 162/358.2 |
| 5,629,052 | A | 5/1997 | Trokhan et al. | |
| 5,906,710 | A * | 5/1999 | Trokhan | 162/109 |
| 5,962,860 | A | 10/1999 | Trokhan et al. | |
| 6,287,641 | B1 | 9/2001 | Ostendorf et al. | |
| 6,420,100 | B1 * | 7/2002 | Trokhan et al. | 430/320 |
| 6,743,571 | B1 | 6/2004 | Hill et al. | |
| 7,914,649 | B2 * | 3/2011 | Ostendorf et al. | 162/348 |
| 2004/0084167 | A1 * | 5/2004 | Vinson et al. | 162/348 |

FOREIGN PATENT DOCUMENTS

| | | |
|---|---|---|
| EP | 0 851 060 A2 | 7/1998 |
| WO | WO 2008/054686 A2 | 5/2008 |

OTHER PUBLICATIONS

International Search Report Mailed Feb. 16, 2011.

* cited by examiner

*Primary Examiner* — Eric Hug

(74) *Attorney, Agent, or Firm* — Roddy M. Bullock; Wednesday G. Shipp

(57) ABSTRACT

A macroscopically monoplanar secondary belt for manufacturing a cellulosic fibrous structure is provided. The belt, having two mutually orthogonal principal directions, a machine direction and a cross machine direction, and having a reinforcing structure; and a framework of protuberances joined to said reinforcing structure and extending outwardly therefrom to define deflection conduits between the protuberances, the framework of protuberances having a semicontinuous pattern and the deflection conduits having a semicontinuous pattern, is further provided. The protuberances and the deflection conduits have a vector component extending substantially throughout one principal direction of the belt, each protuberance of the pattern being spaced apart from an adjacent protuberance in the pattern. The protuberances have primary protuberances having a first width, T and the nodes have a second width, N, wherein a ratio of N to T is from about 1.5 to about 5.

18 Claims, 3 Drawing Sheets

BELT HAVING SEMICONTINUOUS PATTERNS AND NODES

CROSS REFERENCE TO RELATED APPLICATION

This application claims the benefit of U.S. Provisional Application No. 61/262,608, filed Nov. 19, 2009.

FIELD OF THE INVENTION

The present invention relates to belts used for making cellulosic fibrous structures, such as paper towel or toilet tissue products. Particularly this invention relates to a belt used in a through-air drying process for making cellulosic fibrous structures, and more particularly to a belt having a particular pattern thereon which imparts properties to the paper in a like pattern.

BACKGROUND OF THE INVENTION

Cellulosic fibrous structures, such as paper, are well known in the art. For example, cellulosic fibrous structures are a staple of every day life and are found in facial tissues, toilet tissue, and paper toweling.

Specifically a secondary belt used in the wet end of the papermaking process can affect the properties imparted to the cellulosic fibrous structure such as caliper and CD stretch. Controlling, maximizing, and maintaining CD stretch properties and caliper properties, that is generated in the wet end of papermaking, throughout the dry end processing of paper webs such as converting, is often challenging. In addition these secondary belts also need to be durable and designed such that they withstand high temperature and pressure during the manufacturing of cellulosic fibrous structures. Otherwise these belt need to be replaced or repaired frequently, thus driving up manufacturing costs.

Accordingly, a need exists to provide greater control over the caliper and CD stretch, of the cellulosic fibrous structure, while also maximizing the belt life in the papermaking process.

SUMMARY OF THE INVENTION

The inventions relates to a macroscopically monoplanar secondary belt for manufacturing a cellulosic fibrous structure, and having two mutually orthogonal principal directions, a machine direction and a cross machine direction, the belt comprising:

a reinforcing structure; and a framework of protuberances joined to said reinforcing structure and extending outwardly therefrom to define deflection conduits between the protuberances, the framework of protuberances comprising a semicontinuous pattern and the deflection conduits comprising a semicontinuous pattern, the protuberances and the deflection conduits having a vector component extending substantially throughout one principal direction of the belt, each protuberance of the pattern being spaced apart from an adjacent protuberance in the pattern;

the protuberances comprising primary protuberances having a first width, T, and nodes having a second width, N, wherein a ratio of N to T is from about 1.5 to about 5.

BRIEF DESCRIPTION OF THE DRAWINGS

While the specification concludes with claims particularly pointing out and distinctly claiming the present invention, it is believed the invention will be better understood by the following specification taken in conjunction with the associated drawings in which like components are given the same reference numeral, and:

DETAILED DESCRIPTION OF THE INVENTION

Definitions

Figure 1:
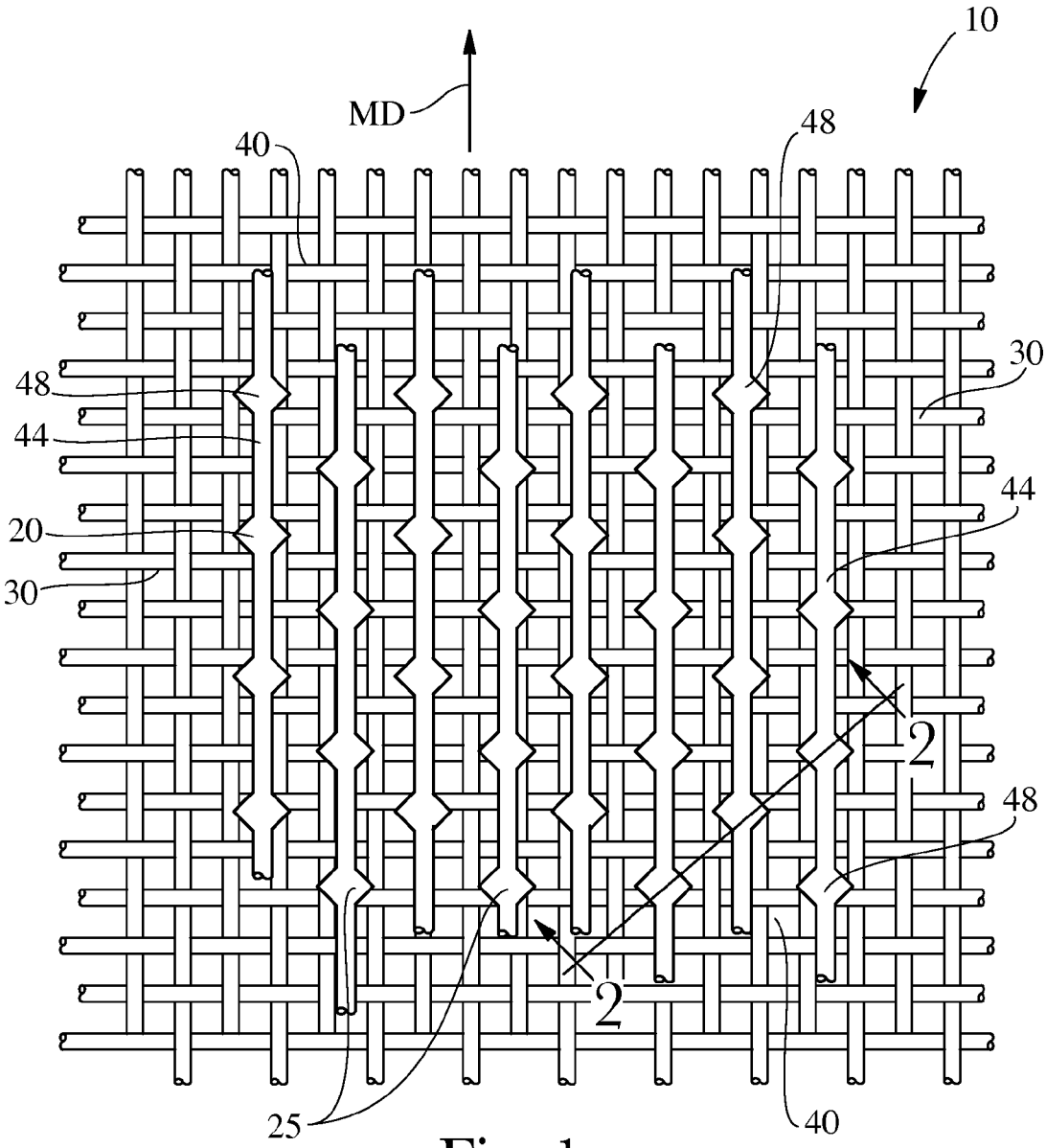
FIG. 1 is a top plan view of a secondary belt according to the present invention having a reinforcing structure and a framework of protuberances having deflection conduits therebetween.

As used herein, a "secondary belt" or "belt" refers to an apparatus or a belt, respectively, having an embryonic web contacting surface and which is used to carry or otherwise process an embryonic web of cellulosic fibers after initial formation in the wet end of the papermaking machinery. A secondary belt may include, without limitation, a belt used for molding an embryonic web of the cellulosic fibrous structure, a through-air drying belt, a belt used to transfer the embryonic web to another component in the papermaking machinery, or a backing wire used in the wet end of the papermaking machinery (such as a twin-wire former) for purposes other than initial formation. A belt according to the present invention does not include embossing rolls, which deform dry fibers after fiber-to-fiber bonding has taken place. Of course, a cellulosic fibrous structure according to the present invention may be later embossed, or may remain unembossed.

"Basis Weight", as used herein, is the weight per unit area of a sample of fibrous structure reported in lbs/3000 $ft^2$ or $g/m^2$.

"Fiber" as used herein means an elongate particulate having an apparent length greatly exceeding its apparent diameter, i.e. a length to diameter ratio of at least about 10. Fibers having a non-circular cross-section are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, including wood fibers, or synthetic fibers made from natural polymers and/or synthetic fibers, or any other suitable fibers, and any combination thereof.

"Fibrous structure" as used herein means a structure (web) that comprises one or more fibers. Nonlimiting examples of processes for making fibrous structures include known wet-laid fibrous structure making processes, co-forming fibrous structure making processes, etc. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. The fibrous structure may be a through-air-dried fibrous structure and/or conventionally dried fibrous structure. The fibrous structure may be creped or uncreped. The fibrous structure may exhibit differential density regions. The fibrous structure may be pattern densified. The fibrous structures may be homogenous or multilayered in construction.

After and/or concurrently with the forming of the fibrous structure, the fibrous structure may be subjected to physical transformation operations such as embossing, calendaring, selfing, printing, folding, softening, ring-rolling, applying additives, such as latex, lotion and softening agents, combining with one or more other plies of fibrous structures, and the like to produce a finished fibrous structure product.

As used herein, "fibrous structure products" or "paper products" or "products" mean paper products comprising fibrous structure, usually cellulose fibers. In one embodiment, the products of the present invention include tissue-towel paper products, including paper toweling, facial tissue, bath tissue, table and/or napkins. The products of the present invention may be in any suitable form, such as in a roll, in individual sheets, in connected, but perforated sheets, in a folded format or even in an unfolded format.

Figure 2:
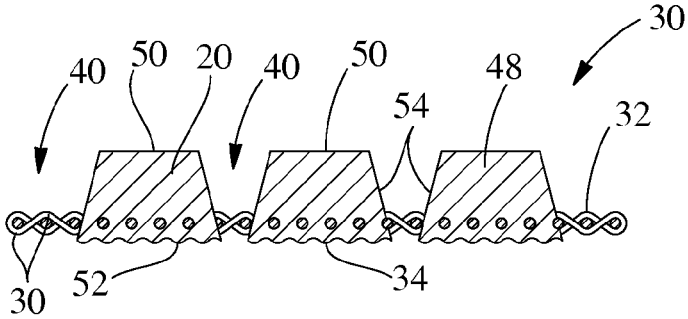
FIG. 2 is a diagonal sectional view taken along lines 2-2 of FIG. 1.

As shown in FIGS. 1 and 2 the invention comprises a belt 10 for manufacturing a cellulosic fibrous structure. For example, the belt 10 embodiment of an apparatus according to the present invention comprises two primary elements: a patterned framework of protuberances 20 and a reinforcing structure 30. The reinforcing structure 30 of the belt 10 has two opposed major surfaces. One major surface is the paper contacting side 32 and from which the protuberances 20 extend. The other major surface of the reinforcing structure 30 of the belt 10 is the backside 34, which contacts the machinery employed in a typical papermaking operation. Machinery employed in a typical papermaking operation include vacuum pickup shoes, rollers, etc., as are well known in the art and will not be further discussed herein.

Generally, for a belt 10 according to the present invention, the "machine direction" of the belt 10 is the direction within the plane of the belt 10 parallel to the principal direction of travel of the cellulosic fibrous structure during manufacture. The machine direction is designated by arrows "MD" in FIG. 1. The cross machine direction is generally orthogonal the machine direction and also lies within the plane of the belt 10. The Z-direction is orthogonal both the machine direction and cross machine direction and generally normal to the plane of the belt 10 at any position in the papermaking process. The machine direction, cross machine direction, and Z-direction form a Cartesian coordinate system.

The belt 10 according to the present invention is essentially macro-scopically monoplanar. As used herein a component is "macroscopically monoplanar" if such component has two very large dimensions in comparison to a relatively small third dimension. The belt 10 is essentially macroscopically monoplanar in recognition that deviations from absolute planarity are tolerable, but not preferred, so long as the deviations do not adversely affect the performance of the belt 10 in making cellulosic fibrous structures thereon.

In a belt 10 embodiment, the reinforcing structure 30 comprises a series of filaments, in one embodiment woven in a rectangular pattern to define interstices therebetween. The interstices allow fluids, such as drying air, to pass through the belt 10 according to the present invention. In an embodiment the interstices form one of the groups of openings in the belt 10 according to the present invention, which openings are smaller than those defined by the deflection conduits between the patterned framework of protuberances 20.

If desired, the reinforcing structure may have vertically stacked machine direction filaments to provide increased stability and load bearing capability. By vertically stacking the machine direction filaments of the reinforcing structure, the overall durability and performance of a belt 10 according to the present invention is enhanced. The reinforcing structure 30 should not present significant obstruction to the flow of fluids, such as drying air therethrough and, therefore, should be permeable (and may be highly permeable). The permeability of the reinforcing structure 30 may be measured by the airflow therethrough at a differential pressure of about 1.3 centimeters of water (0.5 inches of water). In an embodiment a reinforcing structure 30 having no framework of protuberances 20 attached thereto should have a permeability at this differential pressure of about 240 to about 490 standard cubic meters per minute per square meter of belt 10 area (800 to 1,600 standard cubic feet per minute per square foot). Of course, it will be apparent that the permeability of the belt 10 will be reduced when the framework of protuberances 20 is attached to the reinforcing structure 30. In an embodiment the belt 10 having a framework of protuberances 20 has an air permeability of about 90 to 180 standard cubic meters per minute per square meter (300 to 600 standard cubic feet per minute per square foot).

In an alternative embodiment, the reinforcing structure 30 of a belt 10 according to the present invention may have a textured backside 34. The textured backside 34 has a surface topography with asperities to prevent the buildup of papermaking fibers on the backside 34 of the belt 10, reduces the differential pressure across the belt 10 as vacuum is applied thereto during the papermaking process, and increases the rise time of the differential pressure prior to the maximum differential pressure occurring.

In an embodiment a reinforcing structure 30 or belt 10 for use with the present invention may be made in accordance with the teachings of commonly assigned U.S. Pat. No. 5,098,522 issued Mar. 24, 1992 to Smurkoski, et al. U.S. Pat. Nos. 4,514,345; 5,073,235; 5,260,171; 5,629,052, 6,287,641; 5,962,860; 6,743,571.

The other primary component of the belt 10 according to the present invention is the patterned framework of protuberances 20. The protuberances 20 define deflection conduits 40 therebetween. The deflection conduits 40 allow water to be removed from the cellulosic fibrous structure by the application of differential fluid pressure, by evaporative mechanisms, or both when drying air passes through the cellulosic fibrous structure while on the belt 10 or a vacuum is applied through the belt 10. The deflection conduits 40 allow the cellulosic fibrous structure to deflect in the Z-direction and generate the caliper of and aesthetic patterns on the resulting cellulosic fibrous structure.

Figure 3:
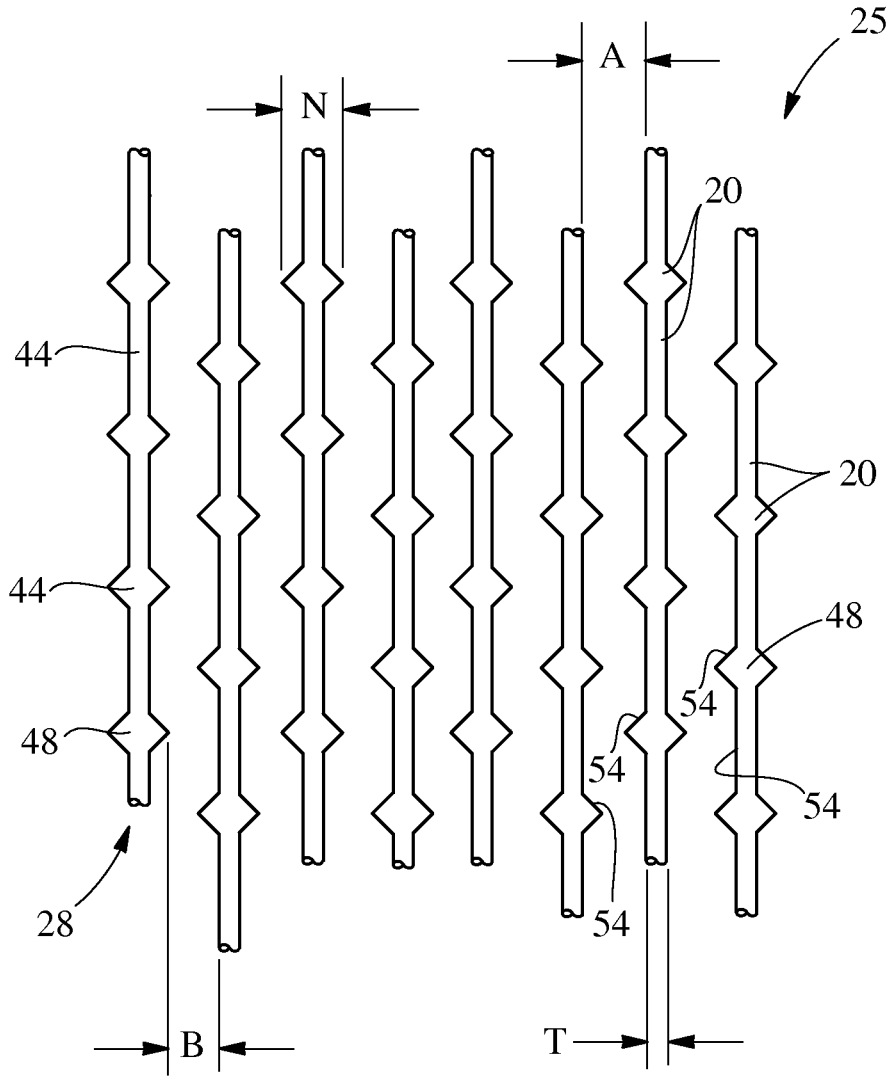
FIG. 3 is a top plan view of the framework of protuberances of the secondary belt according to FIG. 1.

In FIGS. 1, 2 and 3, in an embodiment the protuberances 20 are arranged in a semicontinuous pattern 25. One particular semicontinuous pattern 25 is shown in FIGS. 1, 2 and 3. As used herein, a pattern of protuberances 20 is considered to be "semicontinuous" if a plurality of the protuberances 20 extends substantially throughout one dimension of the apparatus, and each protuberance 20 in the plurality is spaced apart from adjacent protuberances 20.

In an embodiment the protuberances 20 have a vector component extending substantially throughout one principal direction of the belt 10, each protuberance of the pattern being spaced apart from an adjacent protuberance in the pattern. The protuberances comprise a plurality of primary protuberances 44 having a first width "T" and nodes 48 having a second width "N". In an embodiment the belt 10 may exhibit a ratio of N to T of from about 1.5 to about 5. In another embodiment the ratio of N to T is from about 2 to about 4 and/or from about 2 to about 3. In an embodiment the plurality of primary protuberances have substantially equivalent width.

All of the nodes of a belt may be substantially identical in surface area, size and shape, wherein the second width, N, of the nodes, may be the maximum width of the node.

The belt may also have nodes comprising general plane geometry shapes selected from the group consisting of squares, circles, ellipses, ovals, rectangles, triangles, pentagons, hexagons, and combinations thereof. The belt may also comprise nodes comprise non-plane geometry shapes. For example, the non plane geometry shapes may be selected from the group consisting of stars, flowers, hearts, and combinations thereof. Belts having nodes that are not identical in surface area, size and shape, and have nodes of varied sizes and shapes, the second width, N, may be an average of the maximum width of each shape and size of nodes present on the belt.

The nodes may be arranged in any desired matrix. The nodes may be aligned in either or both the machine direction and/or cross machine direction. The nodes may be staggered, for example in a non-random pattern, in either the machine direction, the cross machine direction, or, alternatively, nodes may be bilaterally staggered. For the embodiments described herein, node frequency may be about 50 to about 200 per square inch and/or about 75 to about 190 per square inch and/or about 100 to about 180 per square inch.

The protuberances 20 in the semicontinuous pattern 25 may comprise a plurality of primary protuberances 44 and a plurality of nodes 48. FIGS. 1 and 3 show a belt 10 wherein the primary protuberances 44 are spaced substantially equidistance from the adjacent primary protuberances 44. The primary protuberances 44 may be parallel to adjacent primary protuberances 44. The plurality of the primary protuberances comprising said pattern may be generally parallel to the principal direction of the belt. FIG. 3 is a top plan view of the framework of protuberances of the belt according to FIG. 1.

The primary protuberances 44 comprise a first width T of from about from about 5 mils (0.005 inches) to about 40 mils (0.04 inches).

As shown in FIGS. 1 and 3 the primary protuberances 44 may be generally parallel so as to form a pattern in which the nodes 48 of adjacent protuberances 20 are offset from one another with respect to the phase of the pattern as illustrated. The protuberances 20 may be aligned in any direction within the plane of the belt 10.

The protuberances 20 may span the entire cross machine direction of the belt 10, may span the entire machine direction of the belt 10, or may run diagonally relative to the machine and cross machine directions of the belt. Of course, the direction of the protuberance 20 alignment (machine direction, cross machine direction, and/or diagonal) refers to the principal alignment of the protuberances 20. Within each alignment, the protuberance 20 may have nodes aligned at other directions, but aggregate to yield the particular alignment of the entire protuberance 20.

The framework of protuberances 20 arranged in a semicontinuous pattern 25 are to be distinguished from a pattern of discrete protuberances, in which any one protuberance does not extend substantially throughout a principal direction of the belt 10. An example of discrete protuberances is found at FIG. 4 of commonly assigned U.S. Pat. No. 4,514,345 issued Apr. 30, 1985 to Johnson, et al.

Similarly, a framework of protuberances 20 in a semicontinuous pattern 25 is to be distinguished from protuberances forming an essentially continuous pattern. An essentially continuous pattern extends substantially throughout both the machine direction and cross machine direction of the belt 10, although not necessarily in a straight line fashion. Alternatively, a pattern may be continuous because the framework forms at least one essentially unbroken net-like pattern. Examples of protuberances forming an essentially continuous pattern are illustrated by FIGS. 2-3 of the aforementioned U.S. Pat. No. 4,514,345 issued to Johnson, et al or by the aforementioned U.S. Pat. No. 4,528,239 issued to Trokhan.

As illustrated in FIG. 2, the framework of protuberances 20 in a semicontinuous pattern according to the present invention is joined to the reinforcing structure 30 and extends outwardly from the paper contacting side 32 thereof in the Z-direction. The protuberances 20 may have straight sidewalls, tapered sidewalls, and be made of any material suitable to withstand the temperatures, pressures, and deformations which occur during the papermaking process. In one embodiment the protuberances 20 are made of photosensitive resins.

The photosensitive resin, or other material used to form the pattern of protuberances 20, may be applied and joined to the reinforcing structure 30 in any suitable manner. In an embodiment the manner of attachment and joining is applying liquid photosensitive resin to surround and envelop the reinforcing structure 30, cure the portions of the liquid photosensitive resin which are to form the semicontinuous pattern of the protuberances 20, and wash away the balance of the resin in an uncured state. Suitable processes for manufacturing a belt 10 in accordance with the present invention are disclosed in the aforementioned U.S. Pat. No. 4,514,345 issued to Johnson, et al., commonly assigned U.S. Pat. No. 4,528,239 issued Jul. 9, 1985 to Trokhan, and the aforementioned U.S. Pat. No. 5,098,522 issued to Smurkoski, et al. As indicated in these references, the framework of protuberances 20 may be determined by transparencies in a mask through which an activating wave length of light is passed. The activating light cures portions of the photosensitive resin opposite the transparencies. Conversely, the portions of the photosensitive resin opposite the opaque regions of the mask are washed away, leaving the paper contacting side 32 of the reinforcing surface exposed in such areas.

Thus, to form an embodiment of a belt 10 according to the present invention, the mask may be formulated with transparent regions having a semicontinuous pattern 25 as described herein. Such a mask will form a like pattern of protuberances 20 on the belt 10.

Figure 4:
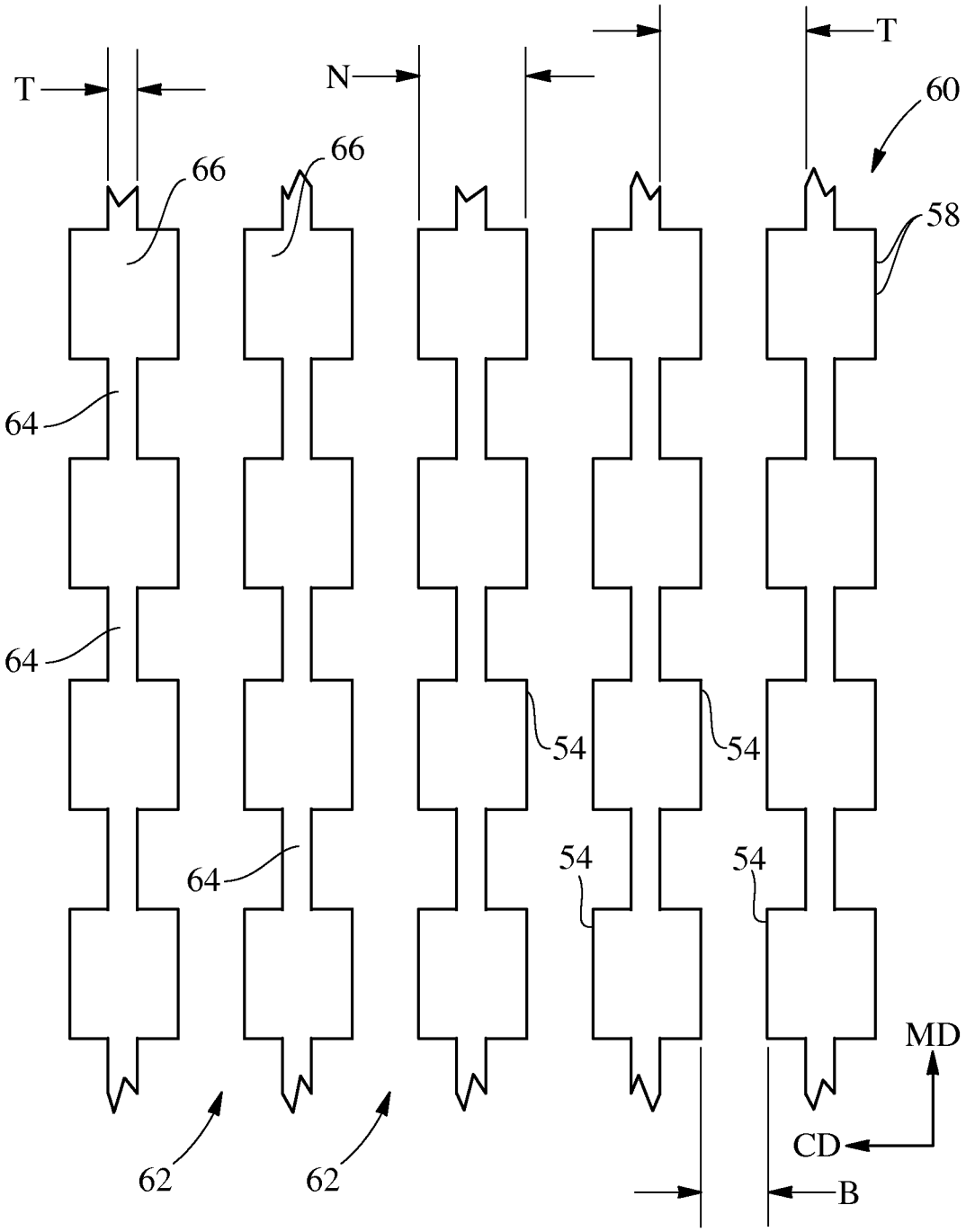
FIG. 4 is a top plan view of an alternative embodiment of a framework of protuberances for use with the reinforcing structure of the secondary belt according to FIG. 1.

FIG. 4 shows a top plan view of an alternate embodiment a framework of protuberances 58 arranged in a semicontinuous pattern 60 that may be used alternative pattern in associated with the reinforcing structure of FIG. 1. In an embodiment the protuberances 58 have a vector component extending substantially throughout one principal direction of the belt 10, each protuberance of the pattern being spaced apart from an adjacent protuberance in the pattern. The protuberances comprise a plurality of primary protuberances 64 having a first width "T" and nodes 66 having a second width "N". In an embodiment the ratio of N to T of from about 1.5 to about 5 and/or the ratio of N to T is from about 2 to about 4 and/or from about 2 to about 3. As shown in FIG. 4, in an embodiment the plurality of primary protuberances 64 have substantially equivalent width and all of the nodes 66 may be substantially identical in surface area, size and shape, wherein the second width, N, of the nodes, may be the maximum width of the node.

The protuberances 58 in the semicontinuous pattern 60 may comprise a plurality of primary protuberances 64 and a plurality of nodes 66. FIG. 4 shows the primary protuberances 64 are spaced substantially equidistance from the adjacent primary protuberances 64. The primary protuberances 64 may be parallel to adjacent primary protuberances 64. The plurality of the primary protuberances 64 comprising said pattern may be generally parallel to the principal direction of the belt. The primary protuberances 64 comprise a first width T of from about from about 5 mils (0.005 inches) to about 40 mils (0.04 inches). As shown in FIG. 4 the primary protuberances 64 may be generally parallel so as to form a pattern in which the nodes 66 of adjacent protuberances 58 are not offset from one another with respect to the phase of the pattern as illustrated. The protuberances 58 may be aligned in any direction within the plane of the belt 10.

For example protuberances 20 forming a semicontinuous pattern may have characteristics which produce desired properties of the cellulosic fibrous structures. The geometry of the protuberances 20 may influences the properties of the resulting cellulosic fibrous structure made on the secondary belt 10. For example, the protuberances 20 may produce hinge lines in the cellulosic fibrous structure, which hinge lines impart softness or enhance the appearance of softness to the fibrous structure.

Furthermore, the semicontinuous pattern of protuberances 20 will yield a like semicontinuous pattern of high and low density regions in the cellulosic fibrous structure made on this belt 10. Such a pattern in the resulting cellulosic fibrous structure occurs for two reasons. First, the regions of the cellulosic fibrous structure coincident the semicontinuous deflection conduits 40 will be de-densified by the air flow therethrough or will be de-densified by the application of a vacuum to the deflection conduits 40. In an embodiment, the regions of the cellulosic fibrous structure coincident the protuberances 20 will be densified by the transfer of the cellulosic fibrous structure to a rigid backing surface, such as a Yankee drying drum.

In an embodiment the geometry of the protuberances 20 may be considered in a single direction, or may be considered in two dimensions, and may be considered as either lying within or normal to the plane of the secondary belt 10 according to the present invention.

Particularly, the Z-direction extent of the protuberances 20 in a single direction normal to the plane of the belt 10 determines the height of the protuberances 20 above the paper contacting side 32 of the reinforcing structure 30. If the height of the protuberances 20 is too great, pinholing and apparent transparencies or light transmission through the cellulosic fibrous structure will occur. Conversely, if the Z-direction dimension of the protuberances 20 is smaller, the resulting cellulosic fibrous structure will have less caliper. Pinholing and low caliper are undesirable because they present an apparently lower quality cellulosic fibrous structure to the consumer.

In an embodiment the protuberances 20 may have a height between about 0.05 millimeters and about 0.76 millimeters (0.002 and 0.030 inches), and/or between about 0.13 millimeters and about 0.66 millimeters (0.005 and 0.026 inches), and/or between about 0.20 millimeters and about 0.56 millimeters (0.008 and 0.022 inches).

Referring again to FIGS. 1, 2 and 3 and continuing the single direction analysis, the spacing between inwardly facing edges 54 of adjacent protuberances 20 must be considered both in terms of the distance between the adjacent primary protuberances 44 and the distance between the inwardly facing edges 54 of the nodes 48, for example on one protuberance, and the inwardly facing edges 54 on a primary protuberance 44 of another protuberance. If, within limits, the spacing is too great for a given Z-direction extent, pin-holing is more likely to occur. Also, if the spacing between the inwardly facing edges 54 of adjacent protuberances 20 is too great, another undesired resultant phenomenon may be that fibers will not span the distal ends 50 of adjacent protuberances 20, resulting in a cellulosic fibrous structure having lesser strength than can be obtained if individual fibers span adjacent protuberances 20. Conversely, if the spacing between the inwardly facing edges of adjacent protuberances 20 is too small, the cellulosic fibers will bridge adjacent protuberances 20, and in an extreme case little caliper generation will result. Therefore, the spacing between the inwardly facing edges 54 of adjacent protuberances 20 must be optimized to allow sufficient initial caliper generation to occur and to be maintained throughout the papermaking and converting process as well as to minimize pin-holing.

In an embodiment and in FIGS. 1 and 3 the protuberances 20 are not of constant width. The nodes 48 of adjacent protuberances 20 may comprise a staggered configuration 28 so that the inwardly facing edges 54 of the nodes 48 of the protuberances 20 are not parallel to each other. In FIGS. 1 and 3 the inwardly facing edges of the primary protuberances 44, however, are parallel to each other. In an embodiment the minimum distance, B, between inwardly facing edges 54 of the protuberances 20, may occur at the inwardly facing edge 54 of a node 44 and the inwardly facing edge 54 of an adjacent primary protuberance 44. In an embodiment B may be from about 20 mils (0.02 inches) to about 80 mils (0.080inches) apart or about 22 mils (0.022 inches) to about 40 mils (0.04 inches) apart in a direction that is generally orthogonal to such surfaces.

In an embodiment the maximum distance, A, between inwardly facing edges 54 of the protuberances 20, may occur at the inwardly facing edge 54 of a primary protuberance 44 and the inwardly facing edge of an adjacent primary protuberance 44. In an embodiment A may be from about 40 mils to about 100 mils apart (about 0.040 to about 0.1 inches) or about 42 mils to about 80 mils apart (about 0.042 to about 0.08 inches) or about 45 mils to about 60 mils apart (about 0.044 to about 0.06 inches) in a direction that is generally orthogonal to such surfaces. This spacing will result in a cellulosic fibrous structure which generates maximum and sustainable caliper when made of conventional cellulosic fibers, such as Northern softwood kraft or eucalyptus.

A further single dimension analysis relates to the width across the distal end 50 of the protuberance 20. The width across the distal end is measured generally normal to the principal dimension of the protuberance 20 within the plane of the belt 10 at a given location. As has been noted in the design of prior belts, if the protuberance 20 is not wide enough, the protuberance 20 will not withstand the pressures and temperature differentials encountered during and incidental to the papermaking process. Accordingly, such a belt 10 will have a relatively short life and have to be frequently replaced. Moreover, if the protuberances 20 are too wide, a more one-sided texture will result. Through the addition of the node of a particular size or surface area in relation to the size or surface area of the primary protuberances, more flexibility is achieved in choosing a size and surface area of the primary protuberance. In addition maximal belt life is achieved over a broader range of protuberance sizes than may be achieved for belt without the inclusion of a plurality of nodes. In addition the selection of the node of a particular size and dimension achieves a more stable caliper in the fibrous structure product.

In an embodiment the inwardly facing edges 54 of the protuberances 20 may be tapered and the surface area of the distal ends 50 of the protuberances may be less than the surface area of the proximal ends 52 of the protuberances 20 and hence the surface area of the proximal ends 52 of the protuberances 20 occupy a greater surface area than the distal ends 50.

In some embodiments the proximal ends 52 comprise a surface area, of all of the protuberances 20, from about 25% to about 75% of the belt 10 surface area, and/or from about −25% to about 50% of the belt surface area. In an embodiment the distal ends 50 comprise a surface area, of all of the protuberances 20, from about 15% to about 65% and/or from about 20% to about 40%, of the belt 10 surface area.

In an embodiment the protuberances 20 of the belt 10 do not intersect adjacent protuberances. In an embodiment the protuberances 20 of the belt 10 are in a semicontinuous pattern and are oriented, in the principle direction, in the machine direction.

In an embodiment the deflection conduits 40 of the belt 10 are nonintersecting with one another. In an embodiment the deflection conduits 40, 62 of the belt 10 form a semicontinuous pattern 25, 60 and are oriented, in the principle direction, in the machine direction, as shown in FIGS. 1, 3 and 4.

In an embodiment width of adjacent primary protuberances 44 on the belt 10, as measure orthogonal either on the distal end or the proximal end, are substantially equal width throughout the belt 10. In an embodiment adjacent primary protuberances 44 on the belt 10, are substantially parallel throughout the belt 10.

In an embodiment width of adjacent nodes 48 of the protuberances 20 on the belt 10, as measured orthogonal at the maximum width, either on the distal end or the proximal end of the nodes 48, are substantially equal width throughout the belt 10. In an embodiment the surface area, size, and/or shape of all of the nodes 48 of the protuberances 20 on the belt 10 are substantially equal throughout the belt 10.

Examining the pattern of semicontinuous protuberances 20 in two dimensions, particularly the machine and cross machine directions, the belt 10 in FIGS. 1 and 3, utilizes generally parallel (although not necessarily straight) primary protuberances 44 and generally non-parallel nodes 48. In an embodiment the inwardly facing edges 54 of the primary protuberances 44 have generally equal spacings in the deflection conduits 40 therebetween, so that the size and width of the deflection conduits 40 is not uniform, although it is still semicontinuous.

In an embodiment the nodes 48 on adjacent protuberances 20 do not touch or contact each other and/or are non-contacting. Furthermore, the protuberances 20 may not be of constant width, yielding an arrangement where deflection conduits 40 may have fiber bridging of adjacent protuberances 20 in certain areas and fiber deflection into the deflection conduits 40 in other areas.

In the instant invention a cellulosic fibrous structure has a semicontinuous pattern and two different densities may be formed. The different densities occur due to: 1) low density fibers spanning adjacent protuberances 20 and which deflect in the Z-direction from the distal end 50 of the protuberances 20 an amount at least about the thickness of the high density regions of the cellulosic fibrous structure; and 2) high density densified fibers coincident the distal ends 50 of the protuberances 20.

A semicontinuous pattern forming multiple density cellulosic fibrous structure such as this provides the benefits of more isotropic flexibility, better softness, and the appearance of a more pleasing texture than a like cellulosic fibrous structure made on a secondary belt 10 having parallel protuberances 20 without nodes.

The sizing and spacing of the nodes, primary protuberances, and the protuberances, provides an improved belt design as disclosed herein. While not wishing to be bound by theory, this design provides a fibrous structure having a more heterogeneous distribution of fibers in the x, y, and z directions to provide an increase in stretch capability, e.g. CD stretch, as well as to provide more stable caliper generation in the fibrous structure. If the deflection conduits between the protuberances are too large, the caliper generated during the manufacturing process may not withstand subsequent calendaring or other converting operations, particularly for relatively low basis weight cellulosic fibrous structures. Thus, a relatively lower caliper (and apparently lower quality) product will be presented to the consumer despite adequate caliper generation occurring during manufacture. Also, deflection conduits may increase the one-sidedness of the texture.

Conversely, if the deflection conduits between adjacent protuberances are too small, low caliper generation may result, as noted above relative to the one-dimensional spacing between adjacent protuberances. Furthermore, if the deflection conduits are too small, the width of the distal edges of the distal ends of the protuberances may be too small for a given cell size and poor belt life will again result.

In an alternative embodiment of the invention, the belt 10 having a semicontinuous pattern of protuberances and semicontinuous pattern of deflection conduits may be used as a forming wire in the wet end of the papermaking machine. When such a belt 10 is used as a forming wire in the papermaking machine, a cellulosic fibrous structure having regions of at least two mutually different basis weights will result and may be aligned in either the machine direction, the cross machine direction, or diagonally thereto.

The belt herein may be used to produce fibrous structure products exhibiting a Dry CD Stretch between about 8% to about 20% and/or from about 9% to about 15%.

The belt herein may be used to produce fibrous structure products exhibiting a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 20 to 90 $g/m^2$. In addition, paper towel products made from belts of the present invention may exhibit a basis weight between about 30 $g/m^2$ to about 120 $g/m^2$ and/or from about 40 to 100 $g/m^2$.

Method of Making the Belt

The belt 10 according to the present invention may be made by curing a photosensitive resin through a mask. The mask has first regions which are transparent to actinic radiation and second regions which are opaque to the actinic radiation. The regions in the mask which are transparent to the actinic radiation will form like regions in the photosensitive resin which cure and become the patterned framework 20 of the belt 10 according to the present invention.

Conversely, the regions of the mask which are opaque to the actinic radiation will cause the resin in the positions corresponding thereto to remain uncured. This uncured resin is removed during the beltmaking process and does not form part of the belt 10 according to the present invention.

The belt of the present invention may be formed by a process comprising the following steps:

providing a coating of a liquid curable material, in one embodiment a liquid photosensitive resin, the coating having a first thickness; wherein the liquid curable material is supported by a suitable reinforcing structure supported by a forming surface, the reinforcing structure having a paper contacting side and a backside;

depositing the coating of a liquid photosensitive resin to the paper contacting side of the reinforcing structure;

providing a source of curing radiation;

providing a mask having a pre-selected pattern of transparent regions and opaque regions therein and positioning the mask between the coating of the curable material and the source of curing radiation so that the opaque regions of the mask shield areas of the coating from the curing radiation while the transparent regions of the mask cause other areas of the coating to be unshielded;

curing the unshielded areas of the coating by exposing the coating to the curing radiation through the mask while leaving the shielded areas of the coating uncured, thereby partly-curing the coating; and removing substantially all uncured liquid curable material from the partly-formed papermaking belt to leave a hardened or semi-hardened material structure.

In one embodiment the process further comprises an additional curing step of: further curing the unshielded areas of the coating by exposing the coating to a second source of curing radiation, thereby forming a fully-cured coating, to leave a hardened resinous structure. This resinous structure forms the patterned framework of protuberances.

In one embodiment, a backing film may be provided and positioned between the backside of the reinforcing structure and the forming surface, to protect the forming surface from being contaminated by the liquid resin.

The thickness of the coating can be controlled by, for example, a roll, a bar, a knife, or any other suitable means known in the art.

In its industrial application, the processes of making the papermaking belt, described herein, can comprise a continuous process. For example, the continuous process of making the papermaking belt comprises the following steps:

providing a coating of a liquid curable material supported by a reinforcing structure, the reinforcing structure supported by a forming surface, and continuously moving the forming surface, reinforcing structure with the coating in a machine direction, the coating having a bottom surface forming the proximal ends of the protuberances, a top surface opposite to the bottom surface which forms the distal ends of the protuberances, and a first thickness defined between the top and bottom surfaces;

providing a source of curing radiation structured and configured to emit a curing radiation to continuously cure the coating supported by the reinforcing structure moving in the machine direction;

continuously providing a transparent mask;

continuously printing the mask to form a pattern of opaque regions therein;

continuously moving the mask having the pattern of opaque regions to position the mask between the coating and the source of curing radiation;

continuously curing the curable material, wherein the opaque regions of the pattern at least partially shield areas of the curable material from the curing radiation such that the areas are cured through at least a portion of the thickness of the coating, thereby partly curing the coating; and continuously removing substantially all uncured material from the partly-formed papermaking belt to leave a hardened material or resinous structure;

further continuously curing the unshielded areas of the coating by exposing the coating to a second source of curing radiation, thereby forming a fully-cured coating, to leave a hardened resinous structure, forming the patterned framework of protuberances of the belt.

Test Methods

Dry CD Stretch

Stretch is the percent cross-machine direction elongation of the fibrous structure product at peak tensile strength and is read directly from a secondary scale on a Thwing-Albert tensile tester.

Prior to tensile testing, the paper samples to be tested should be conditioned according to TAPPI Method #T402OM-88. All plastic and paper board packaging materials must be carefully removed from the paper samples prior to testing. The paper samples should be conditioned for at least 2 hours at a relative humidity of 48 to 52% and within a temperature range of 22 to 24° C. Sample preparation and all aspects of the tensile testing should also take place within the confines of the constant temperature and humidity room.

Discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1 inch (2.54 cm) wide strips in the machine direction from stacks 1 and 3. Cut two 1 inch (2.54 cm) wide strips in the cross direction from stacks 2 and 4. There are now four 1 inch (2.54 cm) wide strips for machine direction tensile testing and four 1 inch (2.54 cm) wide strips for cross direction tensile testing. For these finished product samples, all eight 1 inch (2.54 cm) wide strips are five usable units (also termed sheets) thick.

For unconverted stock and/or reel samples, cut a 15 inch (38.1 cm) by 15 inch (38.1 cm) sample which is 8 plies thick from a region of interest of the sample using a paper cutter (JDC-1-10 or JDC-1-12 with safety shield from Thwing-Albert Instrument Co of Philadelphia, Pa.). Ensure one 15 inch (38.1 cm) cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15 inch (38.1 cm) by 15 inch (38.1 cm) sample which is 8 plies thick, cut four strips 1 inch (2.54 cm) by 7 inch (17.78 cm) with the long 7 (17.78 cm) dimension running parallel to the machine direction. Note these samples as machine direction reel or unconverted stock samples. Cut an additional four strips 1 inch (2.54 cm) by 7 inch (17.78 cm) with the long 7 (17.78 cm) dimension running parallel to the cross direction. Note these samples as cross direction reel or unconverted stock samples. Ensure all previous cuts are made using a paper cutter (JDC-1-10 or JDC-1-12 with safety shield from Thwing-Albert Instrument Co. of Philadelphia, Pa.). There are now a total of eight samples: four 1 inch (2.54 cm) by 7 inch (17.78 cm) strips which are 8 plies thick with the 7 inch (17.78 cm) dimension running parallel to the machine direction and four 1 inch (2.54 cm) by 7 inch (17.78 cm) strips which are 8 plies thick with the 7 inch (17.78 cm) dimension running parallel to the cross direction.

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min (10.16 cm/min) and the 1st and 2nd gauge lengths to 2.00 inches (5.08 cm). The break sensitivity should be set to 20.0 grams and the sample width should be set to 1.00 inch (2.54 cm) and the sample thickness at 0.025 inch (0.0635 cm).

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2-3 seconds passes after starting the test before any value is recorded, the tensile strip is too slack.

Start the tensile tester as described in the tensile tester instrument manual. The test is complete after the cross-head automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

If the percentage elongation at peak (% Stretch) is desired, determine that value at the same time tensile strength is being measured. Calibrate the elongation scale and adjust any necessary controls according to the manufacturer's instructions.

For electronic tensile testers with digital panel meters read and record the value displayed in a second digital panel meter at the completion of a tensile strength test. For some electronic tensile testers this value from the second digital panel meter is percentage elongation at peak (% stretch); for others it is actual inches of elongation.

Repeat this procedure for each tensile strip tested.

Calculations: Percentage Elongation at Peak (% Stretch)—For electronic tensile testers displaying percentage elongation in the second digital panel meter:

Percentage Elongation at Peak (% Stretch)=(Sum of elongation readings) divided by the (Number of readings made).

For electronic tensile testers displaying actual units (inches or centimeters) of elongation in the second digital panel meter:

Percentage Elongation at Peak (% Stretch)=(Sum of inches or centimeters of elongation) divided by ((Gauge length in inches or centimeters) times (number of readings made)) Results are in percent. Whole number for results above 5%; report results to the nearest 0.1% below 5%.

Basis Weight

One stack of 8 plies is made from the preconditioned samples. The stack of 8 plies is cut into a 4 inch by 4 inch square. A rule die from Acme Steel Rule Die Corp. (5 Stevens St. Waterbury Conn., 06714) is used to accomplish this cutting.

For the actual measurement of the weight of the sample, a top loading balance with a minimum resolution of 0.01 g is used. The stack of 8 plies is laid on the pan of the top loading balance. The balance is protected from air drafts and other disturbances using a draft shield. Weights are recorded when the readings on the balance become constant. Weights are measured in grams.

The weight reading is divided by the number of plies tested. The weight reading is also divided by the area of the sample which is normally 16 $in^2$, which is approximately equal to 0.0103 $m^2$.

The unit of measure for basis weight as used herein is grams/square meter. This is calculated using the 0.0103 $m^2$ area noted above.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A macroscopically monoplanar secondary belt for manufacturing a cellulosic fibrous structure, and having two mutually orthogonal principal directions, a machine direction and a cross machine direction, the belt comprising:

a reinforcing structure; and a framework of protuberances joined to said reinforcing structure and extending outwardly therefrom to define deflection conduits between the protuberances, the framework of protuberances comprising a semicontinuous pattern and the deflection conduits comprising a semicontinuous pattern, the protuberances and the deflection conduits having a substantially linear vector component extending substantially throughout one principal direction of the belt, each protuberance of the pattern being spaced apart from an adjacent protuberance in the pattern;

the protuberances comprising primary protuberances having a first width, T, and nodes having a second width, N, wherein a ratio of N to T is from about 1.5 to about 5 and wherein the belt further comprises a node frequency of about 50 per square inch to about 200 per square inch.

2. The belt of claim 1 wherein the ratio of N to T is from about 2 to about 4.

3. The belt of claim 2 wherein the ratio of N to T is from about 2 to about 3.

4. The belt of claim 1 where the nodes comprise a staggered configuration relative to adjacent protuberances.

5. The belt of claim 1 wherein the nodes further comprise inwardly facing edges that are not parallel to adjacent inwardly facing edges of nodes on adjacent protuberances.

6. The belt of claim 1 wherein the one principal direction of the belt is the machine direction.

7. The belt of claim 1 wherein the primary protuberances are spaced substantially equidistant from the adjacent primary protuberances.

8. The belt of claim 1 wherein the primary protuberances are parallel to primary protuberances on adjacent protuberances.

9. The belt of claim 1 wherein the primary protuberances comprising said pattern are generally parallel to the one principal direction of the belt.

10. The belt of claim 1 wherein T is from about 5 mils to about 40 mils.

11. The belt of claim 1 wherein the nodes within a single protuberance are non-randomly spaced apart.

12. The belt of claim 1 wherein all of the nodes of the belt are substantially identical in surface area, size and shape.

13. The belt of claim 1 wherein the nodes comprise general plane geometry shapes selected from the group consisting of squares, circles, ellipses, ovals, rectangles, triangles, pentagons, hexagons, and combinations thereof.

14. The belt of claim 1 wherein the nodes comprise non-plane geometry shapes.

15. The belt of claim 14 wherein the non plane geometry shapes are selected from the group consisting of stars, flowers, hearts, and combinations thereof.

16. The belt of claim 1 wherein the deflection conduits between adjacent protuberances comprise a width of from about 40 mils to about 100 mils.

17. The belt of claim 1 wherein said framework of protuberances comprises a cured photosensitive resin.

18. A macroscopically monoplanar secondary belt for manufacturing a cellulosic fibrous structure, and having two mutually orthogonal principal directions, a machine direction and a cross machine direction, the belt comprising:

a reinforcing structure;

a framework of protuberances joined to said reinforcing structure and extending outwardly therefrom to define deflection conduits between the protuberances, the framework of protuberances comprising a semicontinuous pattern and the deflection conduits comprising a semicontinuous pattern, the protuberances and the deflection conduits having a substantially linear vector component extending substantially throughout one principal direction of the belt, each protuberance of the pattern being spaced apart from an adjacent protuberance in the pattern;

the protuberances comprising primary protuberances having a first width, T, and nodes having a second width, N, wherein a ratio of N to T is from about 1.5 to about 5; and a first protuberance and a second protuberance that is adjacent to the first protuberance, wherein the primary protuberances of the first protuberance are equidistance and parallel to primary protuberances of the second protuberance and wherein the nodes of the first protuberance are not equidistance and not parallel to nodes of the second protuberance.

* * * * *